US006715782B2

(12) United States Patent
Sosin et al.

(10) Patent No.: US 6,715,782 B2
(45) Date of Patent: Apr. 6, 2004

(54) METHOD AND APPARATUS FOR THE CUSTOMIZATION OF BOOT PLACEMENT ON SKIS

(76) Inventors: Clifford Sosin, P.O. Box 138, Southport, CT (US) 06490; Howard B. Sosin, P.O. Box 138, Southport, CT (US) 06490

( * ) Notice: Subject to any disclaimer, the term of this patent is extended or adjusted under 35 U.S.C. 154(b) by 0 days.

(21) Appl. No.: 09/774,522

(22) Filed: Jan. 31, 2001

(65) Prior Publication Data

US 2002/0017772 A1 Feb. 14, 2002

Related U.S. Application Data

(60) Provisional application No. 60/223,020, filed on Aug. 4, 2000.

(51) Int. Cl.[7] ..... A63C 5/00; A63C 1/24; B62M 29/00

(52) U.S. Cl. ..... 280/607; 280/11.14; 280/14.21

(58) Field of Search ..... 280/607, 602, 280/11.14, 11.17, 14.21

(56) References Cited

U.S. PATENT DOCUMENTS

| | | | | | |
|---|---|---|---|---|---|
| 3,900,204 | A | | 8/1975 | Weber | 280/11.13 |
| 3,917,298 | A | * | 11/1975 | Haff | 280/607 |
| 4,085,947 | A | * | 4/1978 | Sarver | 280/601 |
| 4,586,727 | A | * | 5/1986 | Andrieu et al. | 248/188.2 |
| 4,867,470 | A | * | 9/1989 | Clark | 280/611 |
| 5,026,086 | A | * | 6/1991 | Guers et al. | 280/607 |
| 5,090,139 | A | | 2/1992 | Germann | 36/117 |
| 5,172,924 | A | * | 12/1992 | Barci | 280/14.22 |
| 5,188,386 | A | | 2/1993 | Schweizer | 280/607 |
| 5,293,702 | A | | 3/1994 | Miyoshi et al. | 36/117 |
| 5,344,176 | A | | 9/1994 | Trimble | 280/602 |
| 5,346,244 | A | | 9/1994 | Le Masson | 280/607 |
| 5,413,371 | A | | 5/1995 | Trimble | 280/602 |
| 5,520,406 | A | | 5/1996 | Anderson et al. | 280/624 |
| 5,615,901 | A | | 4/1997 | Piotrowski | 280/7.14 |
| 5,671,939 | A | * | 9/1997 | Pineau | 280/602 |
| 5,695,210 | A | | 12/1997 | Goss et al. | 280/624 |
| 5,741,023 | A | | 4/1998 | Schiele et al. | 280/607 |
| 5,765,852 | A | * | 6/1998 | Marega et al. | 280/607 |
| 5,775,717 | A | | 7/1998 | Bobrowicz | 280/607 |
| 5,803,467 | A | | 9/1998 | Piotrowski | 280/7.14 |

(List continued on next page.)

FOREIGN PATENT DOCUMENTS

| | | | | |
|---|---|---|---|---|
| DE | 27 23 864 | | 11/1978 | |
| DE | 4141338 A | * | 6/1993 | A63C/11/26 |
| EP | 740 945 | | 11/1996 | |

OTHER PUBLICATIONS

International Search Report for PCT/US 01/16177 filed May 17, 2001.

*Primary Examiner*—Paul N. Dickson
*Assistant Examiner*—Joselynn Y. Sliteris
(74) *Attorney, Agent, or Firm*—Choate, Hall & Stewart

(57) ABSTRACT

A method and apparatus is disclosed that allows a user to individually or simultaneously customize the pitch, roll, height, yaw, linear placement and lateral placement of his/her boots on his/her skis. This system allows the user to stand in a position while skiing that is closer to his/her natural position and to have the parameters of such a stance measured and quantified, thereby improving comfort, performance, and safety. As opposed to the limited variation in only some parameters described by current art, this invention allows significant variation in all individual parameters and simultaneous customization of all parameters. This simultaneity is important because of its increased ease to the skier and because altering any one parameter can change the center of pressure, thus creating the need for additional changes until the perfect combination of adjustments is made. In particular, the system allows for the alteration of the yaw of the ski boot alone or in combination with any or all of the other parameters.

13 Claims, 7 Drawing Sheets

U.S. PATENT DOCUMENTS 5,822,873 A 10/1998 Meilman ..... 33/365
5,845,923 A * 12/1998 Zanco ..... 280/602
5,873,172 A 2/1999 Siemel ..... 33/512
5,884,934 A 3/1999 DeRocco et al. ..... 280/607
5,895,068 A * 4/1999 Doyle ..... 280/14.21
5,992,861 A 11/1999 Piotrowski ..... 280/7.14

* cited by examiner

UNCORRECTED COMPUTER READOUT yaw left + 5°
right + 8°

74lbs.

68lbs.

CORRECTED COMPUTER READOUT yaw left + 7°
right + 6°

71lbs. 71lbs.

METHOD AND APPARATUS FOR THE CUSTOMIZATION OF BOOT PLACEMENT ON SKIS

This application claims priority from U.S. provisional application Ser. No. 60/223,020 filed on Aug. 4, 2000, the teachings of which are hereby incorporated by reference.

FIELD OF THE INVENTION

The present invention relates to a system for the positioning of ski boots on skis that can customize the pitch, roll, height, yaw, linear and lateral positions of a ski boot relative to a ski.

BACKGROUND OF THE INVENTION

Snow skiing is a sport in which the participant navigates down a snow covered hill by wearing boots that are attached to skis by bindings. People naturally have different stances as a result of their anatomy. Consequently it is beneficial to performance, safety, and comfort to allow the user to separately and simultaneously customize their pitch, roll, height, yaw, linear, and lateral placement of the ski boot on the ski (hereinafter called "parameters").

Pitch is defined as the height of the front relative to the rear of the boot. Because people's legs vary in length and flexibility, individual's preference for pitch vary. Currently, pitch is determined by the boot manufacturer and can be customized to a limited degree by grinding the sole of the boot. Another method for altering pitch is disclosed by DeRocco et al. in U.S. Pat. No. 5,884,934. DeRocco et al. disclose a ski having a binding mounting portion for angling the pitch orientation only of a boot relative to a ski.

Roll, also called cant, is defined as the height of the inner relative to the outer edge of the boot. People who are knock-kneed, people who are bow legged, and everyone in between have unique rolls. Currently, all bindings and binding mounts create a zero degree roll. Boots allow for limited roll customization through mechanisms that alter the cuff angle relative to the shoe of the boot, and by grinding the sole of the boot. Efforts have been made to improve the range of customization with varying success. For example, U.S. Pat. No. 5,293,702 to Miyoshi et al. discloses a boot having a bottom surface allowing the attachment of members to selectively alter the lateral position, longitudinal alignment, and/or cant of a ski boot relative to a ski. Miyoshi et al.'s disclosure applies only to the modification of a ski boot and not of a ski.

Height is defined as the distance from the base of the boot to the base of the ski. People's legs can differ in length, which means that the weight distribution between their feet can be unequal. Commercially available "plates" can raise the skier significantly off the snow. However, current art is not designed to equalize weighting between the feet. Grinding the base of the boot can create limited variation. U.S. Pat. No. 5,090,139 to Germann discloses a ski boot with a height-adjustable foot-bed. Germann's disclosure applies only to the modification of a ski boot and not of a ski.

Linear placement is defined as placement of the boot up and down the length of the ski. Lateral placement is defined as the placement of the boot within the width of the ski. Linear and lateral placement can compensate for changes in the center of pressure (the point under the foot the optimal placement of which optimizes control) caused by other changes, and allows the skier to change the skis performance to his/her personal liking. Both linear and lateral placement can be altered by incorrectly mounting the binding. Binding manufacturers do not recommend this practice.

Yaw is defined as the rotation of the foot around the ankle. Generally people are slightly "duck footed" with an average yaw of approximately fifteen degrees out. However, the yaw of skiers varies from those who are "pigeon-toed" to those who are extremely "duck-footed." Due to this natural variation, yaw is of particular importance in properly adjusting the stance of a skier and currently all bindings require a zero degree yaw and have no means to alter yaw. Slight variations can be achieved by incorrectly mounting the bindings however, binding manufacturers do not recommend this practice.

The ability to deal with all these placement characteristics is important to performance, safety, and comfort. A need exists for a mechanism to allow alteration of the above parameters and in particular yaw alteration, either separately or simultaneously with other parameters, that does not require modification of the specific boot of a user.

SUMMARY OF THE INVENTION

The present invention involves the design of a method and apparatus that allows a user to individually or simultaneously customize the pitch, roll, height, yaw, linear placement and lateral placement of his/her boots on his/her skis. This system allows the user to stand in a position while skiing that is closer to his/her natural position thereby improving comfort, performance, and safety. As opposed to the limited variation in only some parameters described by current art, this invention allows significant variation in all individual parameters and simultaneous customization of all parameters. This simultaneity is important because of its increased ease to the skier and because altering any one parameter can change the center of pressure creating the need for additional changes until the perfect combination of adjustments is made. In particular, the system allows for the alteration of the yaw of the ski boot alone or in combination with any other parameter. Although it is most applicable to downhill snow skiing, this invention can also be used with other snow sports, such as snowboarding or cross-country skiing.

Additionally, it is recognized that there currently exists no clear way to measure many of the necessary changes in pitch, roll, height, yaw, linear, and lateral placement that this system allows. Therefore, the invention describes a measuring device and guidelines to aid in the determination of all appropriate customizations.

BRIEF DESCRIPTION OF THE DRAWING

The invention is described with reference to the several figures of the drawing, in which.

DETAILED DESCRIPTION

Figure 1:
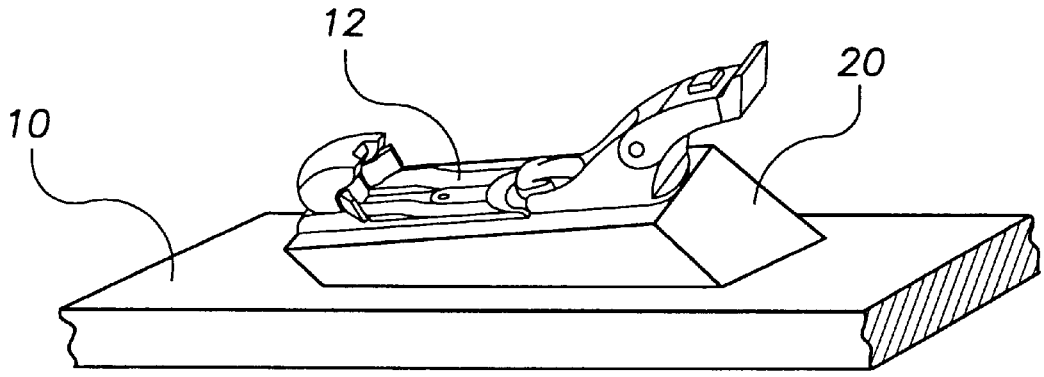
FIG. 1 is an isometric view of the invention utilizing a single customized material sheet as mounted on a ski.
Figure 2A:
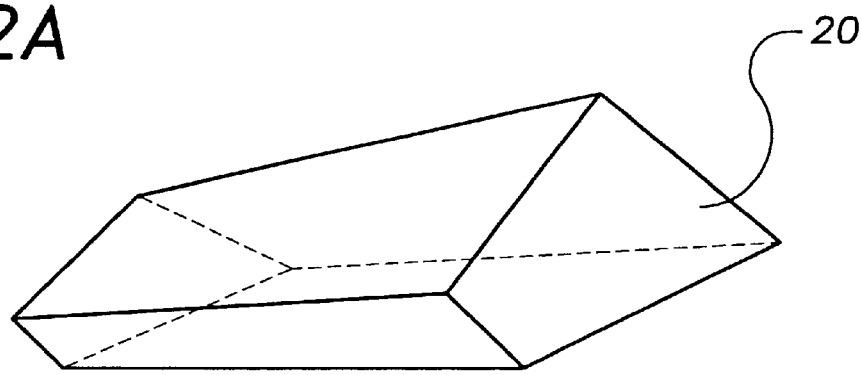
FIG. 2A is an isometric view of the single customized material sheet and FIGS. 2B and 2C are end views showing possible yaw displacements.
Figure 2B:
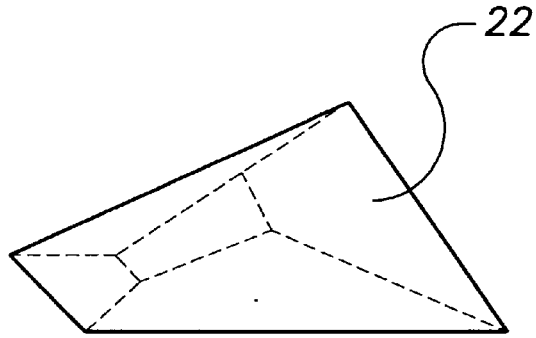
Figure 2C:
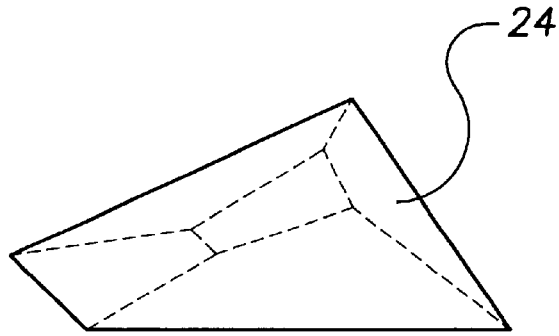
Figure 4A:
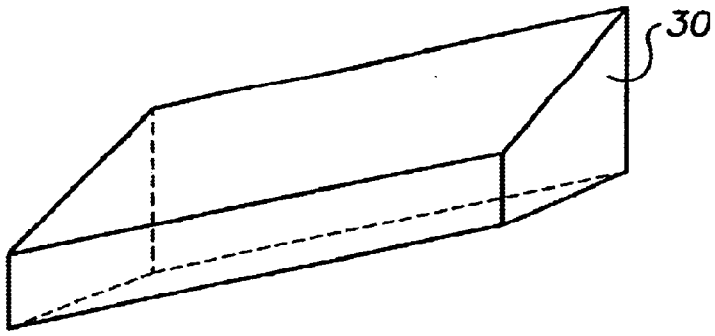
FIGS. 4A–4F are isometric views of prefabricated material sheets that change individual parameters.
Figure 4B:
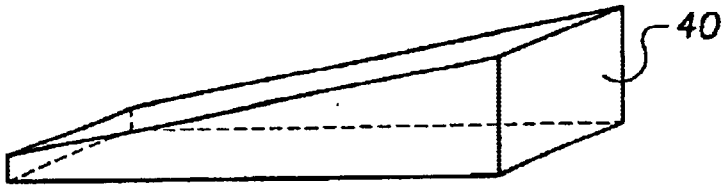
Figure 4C:
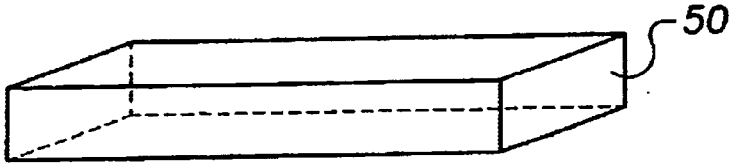
Figure 4D:
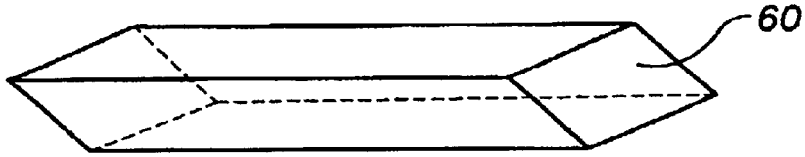
Figure 4E:
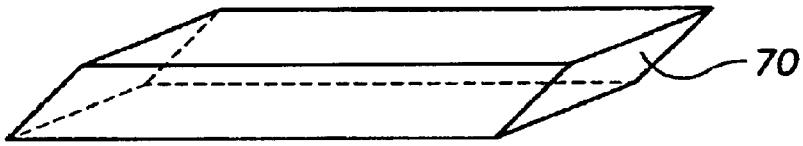
Figure 4F:
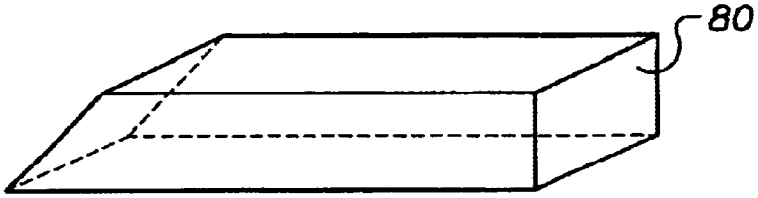

Referring now to the figures of the drawing. FIG. 1 provides an isometric view of a system for customizing boot placement utilizing a single customized material sheet 20. The material sheet 20, affixed to a ski 10, provides a platform on which can be mounted a binding mechanism 12. The shape of the material sheet 20 allows modification of the parameters pitch, roll, height, yaw, linear displacement and lateral displacement which can be seen in FIGS. 2A, 2B, and 2C. FIG. 2A is an isometric view of the single customized material sheet 20 and FIGS. 2B and 2C are end views 22 and 24 showing different possible yaw displacements. Such yaw displacements could be made alone or in combination with other parameters depending on the design of the single customized material sheet. Those skilled in the art know how such a sheet can be created from plastic, metal, wood, foam, or other suitable material. By altering parameters with a separate material sheet rather than through the customization of the boot's sole on which a user will often walk during the course of a day spent skiing, the wear and degradation of the parameter modification is thereby reduced.

Figure 3:
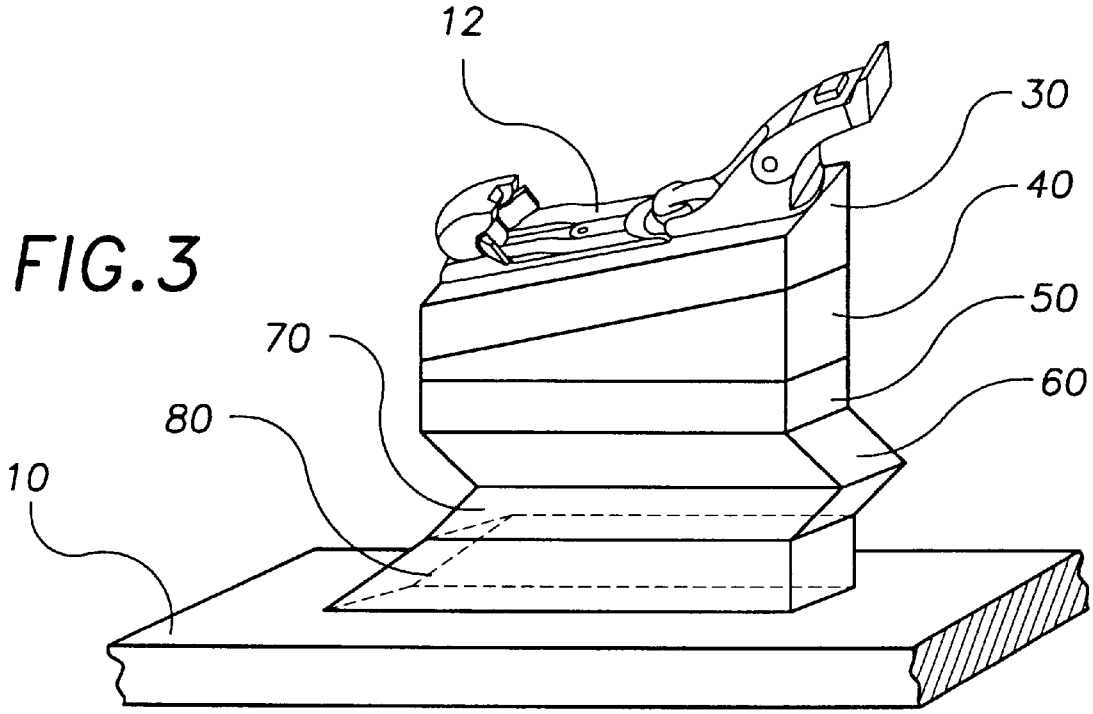
FIG. 3 is an isometric view of the invention utilizing prefabricated material sheets that change individual parameters.
Figure 5A:
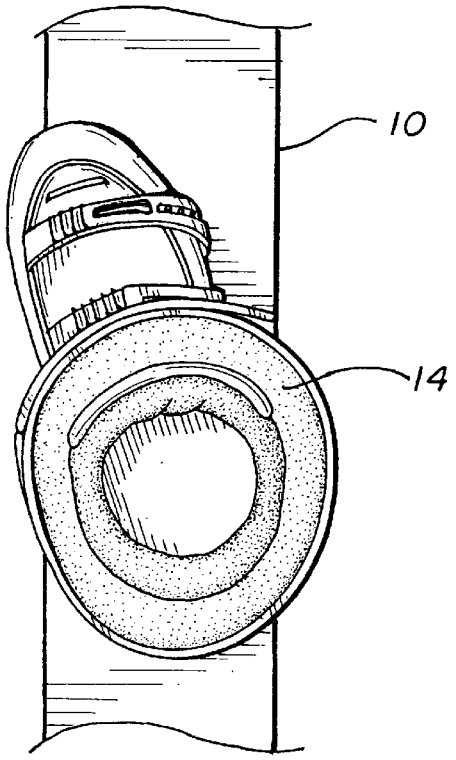
FIGS. 5A and 5B are top-down views of a ski boot on a ski emphasizing possible yaw adjustments.
Figure 5B:
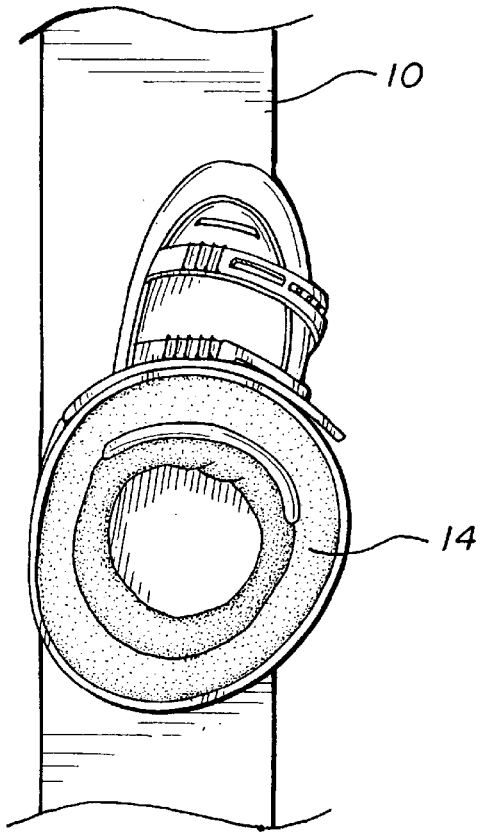

Another variation on this mechanism is the design of a system of interlocking standardized pieces of material that can be connected to create any number of the above-described customized mechanisms. For example, a system of thin interlocking plastic sheets each designed to alter pitch, roll, height, yaw, linear, and lateral placement by discrete amounts can be created as a customized system. This system has the advantage of allowing prefabrication of all needed parts and easy interchangeability. FIG. 3 provides an isometric view of a system for customizing boot placement utilizing multiple material sheets that change individual parameters: roll 30, pitch 40, height 50, linear placement 60, lateral placement 70, and yaw 80. It should be noted that the characteristics of these material sheets have been exaggerated in the figures for purposes of illustration. Such sheets can be prefabricated with standardized dimensions for general applicability. FIGS. 4A–4F provide isometric views of each of the prefabricated materials sheets 30–80 separately. FIGS. 5A and 5B are top-down views of a ski boot 14 on a ski 10 emphasizing possible yaw adjustments. FIG. 5A illustrates a ski boot with a yaw adjustment inward, as in a "pigeon-toed" stance. FIG. 5B illustrates a ski boot with a yaw adjustment outward, as in a "duck-footed" stance.

Figure 6:
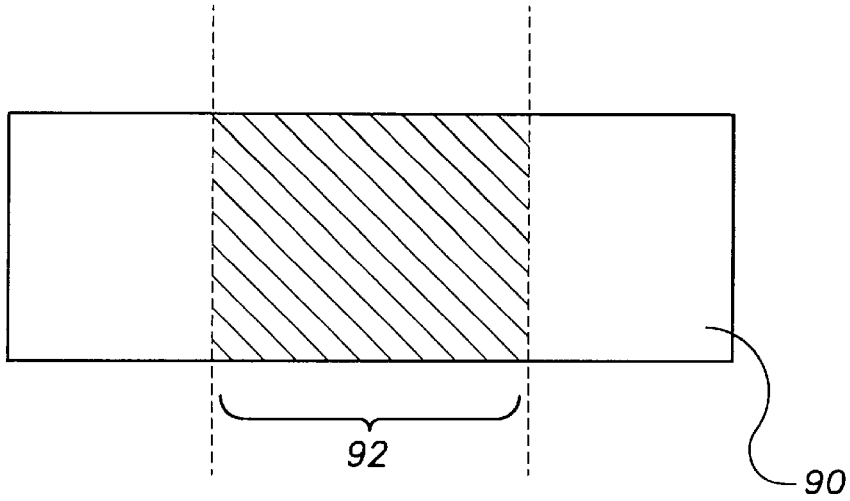
FIG. 6 is a top view of a generic material sheet showing the area that could be removed.

It is important to note that the sheets must be appropriately configured to allow the sheets to fit and interlock together. Such interlocking can involve a variety of dimensions and configurations and is therefore not necessarily restricted to sheets with straight edges. For example, material sheets can be interlocked via curved edges or other type configurations and even in a jig-saw like pattern. The sheets can be held together by screws or other attaching mechanisms known to those of ordinary skill in the art. It is also possible to alter the weight and stiffness of the sheets by removing middle portions of the sheets so that each level is in fact two smaller sheets. Such a technique can serve to reduce the effect of the sheets on the physical characteristics of the ski by dividing a single large piece of material into two or more smaller parts that are each large enough to provide room to mount the binding mechanism. To facilitate the alignment of the pieces of material, a temporary rigid connector between the parts can be added and removed after the system has been installed. FIG. 6 shows a top view of a generic sheet 90 out of which is removed a section 92.

Another embodiment of this invention could include the use of adjustable screws to modify the parameters of the customized system. For example, through the placement of adjustable screws under each of the corners of a flat material sheet, the parameters of such a sheet could be modified according to a user's specification.

Figure 7:
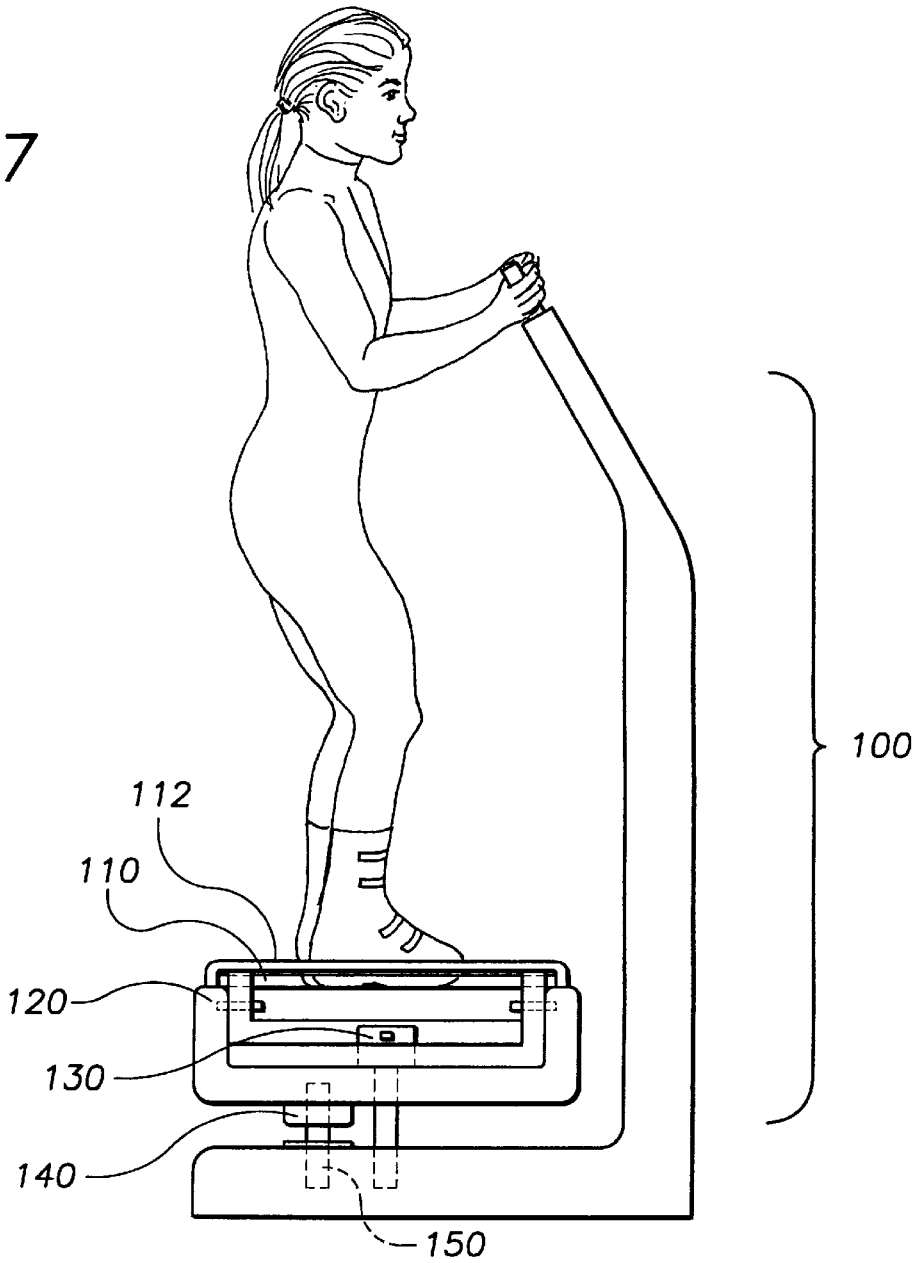
FIG. 7 is a side view of one embodiment of a testing apparatus.

By way of example only, FIG. 7 depicts one possible embodiment of a device 100 for determining the appropriate pitch, yaw and roll angles as well as the appropriate difference in height between two feet, and appropriate linear and lateral positions. The device consists of two pressure boards 110 that are connected to electronics to map the pressure on the boards' surfaces. The boards' pitch and roll angles and height in the z-direction are controlled by a system of joints, screws and locks including a locking roll control 120, a locking pitch control 130 and a locking weight control 140. There is also a pivot assembly 150 to vary the yaw of the entire system.

Figure 8:
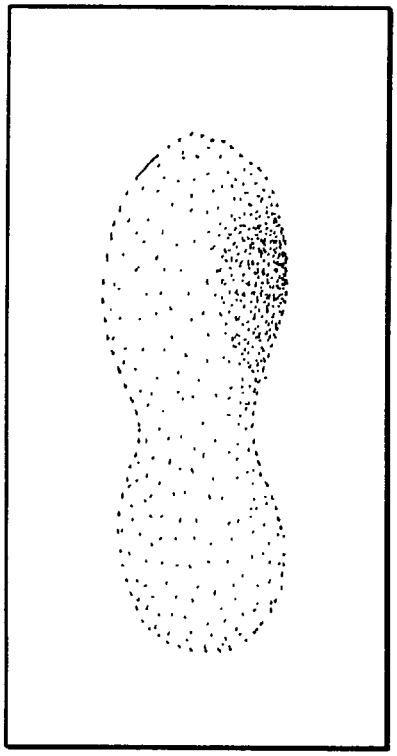
FIG. 8 is a sample computer readout showing uncorrected left and right boot positions.
Figure 8:
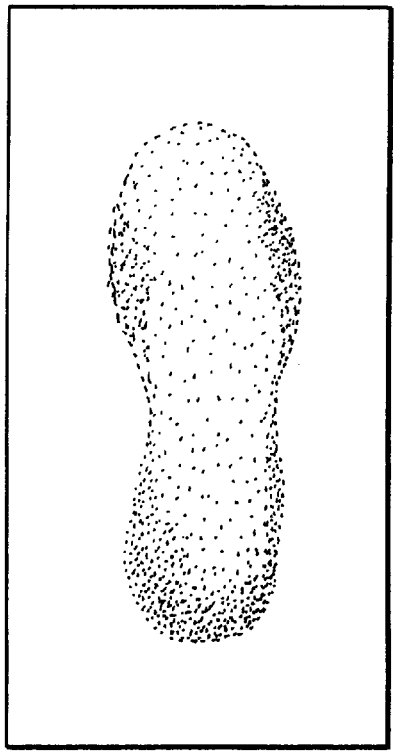
Figure 9:
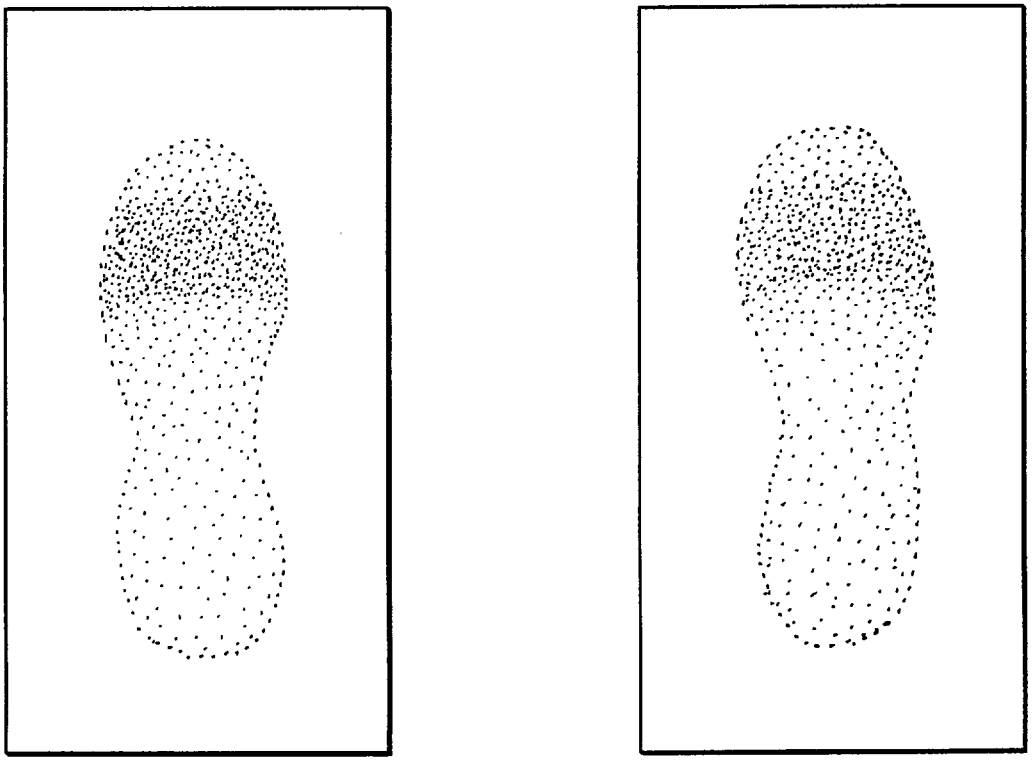
FIG. 9 is a sample computer readout showing corrected left and right boot positions.

One way to determine the appropriate customizations is to have the skier stand in his/her ski boots with one foot on each board. A technician then locks the skier's feet flush and parallel to the boards using, for example, parallel sliding bars 112. Using a readout from the electronics, the technician alters the pitch, roll, and height to equalize the weight between the feet, the weight between the front and rear of each foot, and the weight between the inside and outside of each foot or to the skier's preference. As a result, the user's feet should each be ideally weighted, and the weight should be ideally distributed across the foot. Lastly, the technician "frees" the yaw. The skier then flexes his/her knees without locking them to allow measurement of the skier's "natural yaw" during skiing. If the readout from the pressure map is as desired when the skier stands in his/her natural yaw, then the changes in pitch, height, and roll are optimal. Otherwise, additional adjustments can be made until the optimal placement is found. FIG. 8 shows a sample uncorrected computer readout of a left foot and a right foot in which is illustrated a weight distribution between the feet (74 pounds on the left foot and 68 pounds on the right foot) and uneven pressure on the side of each foot (as illustrated by the darker portions) for a certain yaw measurement setting. FIG. 9 then shows a sample computer readout of the left foot and right foot at a new yaw measurement setting, after the correction of various parameters, in which it is now illustrated that there is equal weighting between feet and the center of pressure of each foot is uniformly applied to the ball of the foot. Correction can be done based on manufacturer recommendations, the determination of the operator, or according to the user's preferences.

Finally, linear and lateral placement can be determined. Ideally, the high-pressure area under the ball of the foot should be placed where the ski manufacturer recommends, where the skier desires, or where the operator recommends. Knowing this point, the appropriate linear and lateral placement can be determined as will be known to those skilled in the art.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A system for customizing placement of a boot relative to a ski, comprising:

a pair of skis; and at least one material sheet having a contact surface attachable to at least one ski of said pair of skis, wherein said at least one material sheet is dimensioned and arranged to alter at least yaw of a boot with respect to the at least one ski while maintaining a desired relative skiing position of said pair of skis during skiing, and wherein said at least one material sheet is attachable to said at least one ski such that a longitudinal axis of the contact surface of the at least one material sheet is substantially parallel with a longitudinal axis of the at least one ski, an amount of yaw adjustment being determined by dimensions of the at least one material sheet itself without altering an angle at which the at least one material sheet is attached to the ski.

2. The system of claim 1, wherein said at least one material sheet alters at least one additional parameter that is selected from the group consisting of pitch, roll, height, linear placement, and lateral placement.

3. The system of claim 1, wherein said at least one material sheet is a single customized sheet designed according to a user's specifications.

4. The system of claim 1, wherein said at least one material sheet is a pre-fabricated sheet with standardized dimensions.

5. The system of claim 1, wherein said at least one material sheet comprises a material sheet in which at least one portion of the sheet has been removed.

6. The system of claim 1, further comprising at least two material sheets, wherein said at least two materials sheets are configured to interlock with one another.

7. The system of claim 6, wherein said at least two material sheets are configured to interlock with one another such that a first parameter change brought about by a first material sheet is not affected by an additional parameter change brought about by an additional material sheet.

8. A method for customizing placement of a boot relative to a ski in a pair of skis, comprising:

attaching at least one material sheet having a contact surface to at least one ski in a pair of skis; and adjusting at least yaw of a boot with respect to said at least one ski by utilizing said at least one material sheet while maintaining a desired relative skiing position of said pair of skis during skiing, and wherein said at least one material sheet is attached to said at least one ski such that a longitudinal axis of the contact surface of the at least one material sheet is substantially parallel with a longitudinal axis of the at least one ski, an amount of yaw adjustment being determined by dimensions of the at least one material sheet itself without altering an angle at which the at least one material sheet is attached to the ski.

9. The method of claim 8, further comprising the step of, adjusting at least one additional parameter that is selected from the group consisting of pitch, roll, height, linear placement, and lateral placement.

10. The method of claim 8, further comprising the step of:

interlocking together at least two material sheets, wherein said at least two material sheets are configured to interlock with one another.

11. The method of claim 10, wherein said interlocking step is performed such that a first parameter change brought about by a first material sheet is not affected by an additional parameter change brought about by an additional material sheet.

12. The method of claim 8, wherein said method comprises:

altering at least two parameters by attaching one material sheet to said ski.

13. A system for customizing placement of a boot relative to a ski, comprising:

a pair of skis; and one material sheet attached to at least one ski of said pair of skis, wherein said material sheet is dimensioned and arranged to alter at least yaw, pitch and roll of a boot with respect to the at least one ski while maintaining a desired relative skiing position of said pair of skis during skiing, an amount of yaw adjustment being determined by dimensions of the material sheet itself without altering an angle at which the material sheet is attached to the ski.

* * * * *